US008102362B2

(12) United States Patent
Ricks et al.

(10) Patent No.: US 8,102,362 B2
(45) Date of Patent: Jan. 24, 2012

(54) INDEXING WRITEHEAD FOR BISTABLE MEDIA

(75) Inventors: Theodore K. Ricks, Rochester, NY (US); Robert G. Capurso, Bergen, NY (US); David M. Johnson, West Henrietta, NY (US); Domenic Maiola, Rochester, NY (US)

(73) Assignee: Industrial Technology Research Institute, Hsinchu (TW)

( * ) Notice: Subject to any disclaimer, the term of this patent is extended or adjusted under 35 U.S.C. 154(b) by 817 days.

(21) Appl. No.: 11/047,926

(22) Filed: Feb. 1, 2005

(65) Prior Publication Data

US 2006/0170981 A1 Aug. 3, 2006

(51) Int. Cl.
*G09G 3/38* (2006.01)

(52) U.S. Cl. ..... 345/105; 345/55; 345/84

(58) Field of Classification Search ..... 345/84, 345/85, 86, 87, 105, 106, 107, 156, 901
See application file for complete search history.

(56) References Cited

U.S. PATENT DOCUMENTS 4,501,471 A 2/1985 Culley et al.
5,389,945 A * 2/1995 Sheridon ..... 345/85
5,695,682 A 12/1997 Doane et al.
6,045,955 A * 4/2000 Vincent ..... 430/45.1
6,407,763 B1 * 6/2002 Yamaguchi et al. ..... 359/296
6,411,316 B1 6/2002 Shigehiro et al.
6,424,387 B2 7/2002 Sato et al.
6,498,597 B1 12/2002 Sawano
6,670,981 B1 12/2003 Vincent et al.
6,806,453 B1 * 10/2004 Vincent et al. ..... 250/208.1
6,809,854 B2 * 10/2004 Yamamoto et al. ..... 359/296
7,130,013 B2 10/2006 Burberry et al.
7,432,899 B2 10/2008 Johnson
7,463,217 B2 * 12/2008 Ricks et al. ..... 345/55
2003/0071800 A1 4/2003 Vincent et al.
2003/0202136 A1 10/2003 Stephenson et al.
2006/0132430 A1 * 6/2006 Ricks et al. ..... 345/108
2006/0168860 A1 * 8/2006 Capurso et al. ..... 40/617
2007/0001927 A1 * 1/2007 Ricks et al. ..... 345/1.1

OTHER PUBLICATIONS

David M. Johnson, "Driving Scheme for Cholesteric Liquid Crystal Display", UUSN Application filed May 14, 2004.

* cited by examiner

*Primary Examiner* — My-Chau T Tran
(74) *Attorney, Agent, or Firm* — Alston & Bird LLP

(57) ABSTRACT

A system and method for writing bistable media with a writehead is described. The media has two or more discrete write areas, each area defined by at least one electrical contact, and the media further has at least one alignment feature positioned with regard to one or more discrete write area. The writehead has corresponding alignment features and electrical conductors to the alignment features and electrical contacts of the media.

21 Claims, 3 Drawing Sheets

INDEXING WRITEHEAD FOR BISTABLE MEDIA

FIELD OF THE INVENTION

A system and method for writing a bistable media using an indexing writehead is provided.

BACKGROUND OF THE INVENTION

Visual information has historically been presented primarily through the use of inks and papers. Once recorded, this information remains unchanging, and unchangeable. The advent of display technology has enabled information to be easily and remotely updateable, but unstable. Loss of power can mean loss of information in a powered device. Bistable display technology offers the best of both worlds, with the stability of paper, but the updateable capabilities of a display. Recent technological advances in materials and manufacturing processes have taken display technology to the next level, enabling flexible, bistable displays. Sometimes known as "rewritable media," this new form of display offers a viable potential replacement for paper and ink.

U.S. Pat. No. 6,411,316 to Shigehiro et al. discloses a means of addressing rewritable media through transfer of an electrostatic latent image from a roller to the media. In U.S. Pat. No. 6,670,981, Vincent et al. describes a similar system with the addition of a laser to imprint a charged image onto a photoconductor for transfer to a rewritable media. An alternative to the electrostatic roller is described by U.S. Pat. No. 6,498,597, in which Sawano discloses a bar-type writing head for use with magnetically driven media. The advantage of all of these systems is a minimal need for alignment between the printhead and preexisting features on the media. It is only critical that the media and head rollers maintain a non-slip relationship to one another, which is achieved through the use of nip rollers. Although generally an advantage, that method of addressing does not allow for potential features that require alignment, such as multiple color pixels. Further, the latent-image or magnetic systems are only capable of addressing media that can be written with a constant electromagnetic field, in close physical contact with the media. Most are not acceptable for use with media that requires variable voltage signals to change the image, such as grey-scale liquid crystal displays, as described in U.S. Ser. No. 10/845,704 filed May 14, 2004. In addition, the electrostatic or electromagnetic fields are very sensitive to any air gaps between the writehead and the media. A single micron of additional air gap can increase the contact resistance such that the system will require an additional 10 volts or more to write the media. Also, any area not in close contact to the head cannot be addressed, so the option to use a narrow writehead electrode to address a wide area on the media, hereafter referred to as "field spreading," is not available.

U.S. Patent Application Publication No. US2003/0071800A1 to Vincent et al. discloses the use of a media translation sensor to identify the instantaneous pixel row location of the media relative to the printhead. This is effective in identifying the position of the media in the direction of web movement, but it does not provide any alignment, measurement, or adaptability to motion perpendicular to the intended axis of movement. In addition, the system still uses direct contact of bistable material and writehead to write the media, subject to contact resistance and lack of field spreading.

Culley et al. propose the concept of using perforations with flexible displays in U.S. Pat. No. 4,501,471. However, their disclosure is relevant only to use as a facilitator to automated handling during production of traditional, matrix displays with permanent electronics. The process described involves the singulation of displays from the perforations prior to use in a consumer product.

In U.S. Pat. No. 6,424,387, Sato et al describes a system having an electronic writehead that moves relative to a rewritable media. The writehead has sensors to determine the location of the endpoints of the media so as not to over-drive the system. However, it does not provide any means of alignment of the rewritable media to the writehead perpendicular to the axis of motion. Sato uses perforations in the display media outside the display area and corresponding projections in the writehead as an aid in the winding of displays into a cartridge.

It would be desirable to have a system capable of writing media in discrete portions such that the system requires lower voltage, has higher image quality, and does not experience variable contact resistance.

SUMMARY OF THE INVENTION

A system and method for writing a bistable media is described, wherein the system comprises bistable media including a substrate, a bistable material layer on the substrate, two or more discrete write areas of the bistable media, each area defined by at least one electrical contact, and at least one alignment feature on the substrate positioned with regard to at least one discrete write area; and a writehead comprising one or more electrical conductors and an alignment feature that interacts with the media alignment feature such that the one or more electrical conductors of the writehead are aligned with the at least one electrical contact of the media.

Advantages

A system and method for writing bistable media is provided wherein the system can write discrete portions of the media, wherein the discrete portions can be written by precise alignment of the media and writehead using alignment features on both, and the writehead can be indexed on the media using the alignment features. The system allows for the writing of media using electronics that are substantially smaller and less complex than the media itself. The system has lower voltage requirements, produces a higher quality image, and reduces variable contact resistance in comparison to a direct contact system.

DETAILED DESCRIPTION OF THE INVENTION

Figure 1:
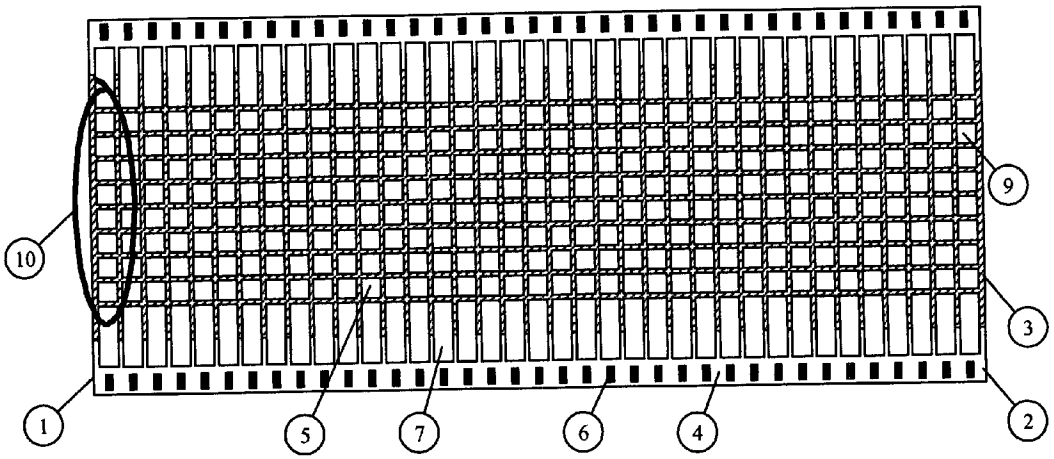
FIG. 1 is a top view of a direct-drive, pixilated media.

An electronic, indexing writehead can be used in conjunction with a media with integral electrodes to form an updateable information system. It has been shown that these limitations of direct contact can be overcome by the use of electrical contacts integral to the media. Rather than contacting bistable material of the media with the writehead electrodes directly, the media can be written by contacting the writehead electrodes to the integral media electrical contacts, and applying a drive signal to the media contacts. The media contacts can be fabricated as an integral layer of the media itself, guaranteeing intimate contact. Use of integral contacts can lower drive voltage, even out electrical fields, enable row-column passive matrix addressing, and provide for current-based drive schemes.

The media can be a rewritable, electronic display element. According to various embodiments, the display element can maintain a desired written message without power. Such display elements can include a bistable material, for example, electrochemical materials; electrophoretic materials, including those manufactured by Gyricon, LLC of Ann Arbor, Mich., and E-ink Corporation of Cambridge, Mass.; electrochromic materials; magnetic materials; and liquid crystal materials. The liquid crystal materials can be twisted nematic (TN), super-twisted nematic (STN), ferroelectric, magnetic, or chiral nematic liquid crystal materials. Chiral nematic liquid crystals can be polymer dispersed liquid crystals (PDLC). Suitable chiral nematic liquid crystal materials include a cholesteric liquid crystal disclosed in U.S. Pat. No. 5,695,682, and Merck BL112, BL118 or BL126, all available from EM Industries of Hawthorne, N.Y.

The display element including a bistable material can be formed by methods known in that art of display making. Wherein the bistable material is liquid crystal material, a support having a first conductive layer can be coated with the bistable material or a pre-formed layer of the bistable material can be placed over the first conductive layer. A second conductive layer can be formed over the bistable material to provide for application of electric fields of various intensity and duration to the bistable material to change its state from a reflective state to a transmissive state, or vice versa. The bistable materials can maintain a given state indefinitely after the electric field is removed. According to various embodiments, one or more conductive layer can be provided external to the bistable media.

The first conductive layer can be patterned into parallel lines, each line forming a separate electrical contact. The second conductive layer can be patterned non-parallel to the patterning of the first conductive layer, forming electrical contacts in the second conductive layer, such that the intersection of the first conductive layer and the second conductive layer forms a pixel. The bistable material in the pixel changes state when an electric field is applied between the first and second conductive layers. The first conductor can be unpatterned and the second conductor can be patterned into electrical contacts in the shape of individual pixels.

The second conductive layer can be electrical contacts formed over the bistable material layer by thick film printing, sputter coating, or other printing or coating methods. The electrical contacts can be any known conductive material, for example, carbon, graphite, or silver. An exemplary material is Electrodag 423SS screen printable electrical conductive material from Acheson Corporation, Port Huron, Mich. The electrical contacts can be arranged to form rows, pixels of any shape, numbers 0-9, a slash, a decimal point, a dollar sign, a cent sign, or any other character or symbol.

The optical state of the bistable material between the first conductive layer and the second conductive layer can be changed by selectively applying an electrical drive signal across the bistable material. This signal can be a voltage, current, or any combination therein. The signal can be applied to either one or both of the second conductive layer and the first conductive layer by direct or indirect contact. Once the optical state of the bistable material has been changed, it can remain in that state indefinitely without further power being applied to the conductive layers. Methods of forming various bistable display elements are known to practitioners in the art, and are taught, for example, in US Applications Publication US 2003/0202136 A1, filed Apr. 29, 2002 by Stephenson et al., and in U.S. Ser. No. 10/851,440 filed May 21, 2004, by Burberry et al.

The media can have two or more discrete writing areas formed by the interaction of the first and second conductive layers. A discrete writing area is defined as an area of the display that can be electronically written without changing the optical state of the remainder of the media. This is typically accomplished by patterning the electrical contacts of the conductive layers such that the discrete area is in electrical isolation from any other discrete area. The electrical contact pattern can have a specific spatial relationship to one or more alignment feature on the media.

The alignment feature can be in the form of one or more mechanical feature, an optically detectable mark, an electrically detectable feature, or a combination thereof. The alignment feature can be, for example, a hole, protrusion, indentation, edge, symbol, mark, electrical contact, fiducial, or any other marking element or feature. The alignment feature can be aligned with a discrete writing area. For example, the alignment feature can designate an edge of a discrete writing area, or can align to at least one electrical contact in the discrete writing area. The alignment feature can be formed simultaneous with, before, or after formation of the electrical contacts during formation of the media.

A desired image can be formed on the display material by selectively changing the optical state of individual areas of the display. This can be accomplished by passing the display media past one or more electrodes, hereafter referred to as the "writehead," which is designed to interact with the display media to apply the appropriate drive signal to change each discrete write area of the display. The display media and writehead can move relative to each another, which allows the image to be formed over a larger area than that which is covered by the writehead. The writehead can be sized to cover one dimension of the display media, for example, the width. Alternately, two or more writeheads can be used together to cover the width of the media. As used herein, "writehead" can include one or more writeheads. For convenience, the relative direction of motion of the writehead to the media will hereafter be referred to as the "x-direction," or "along" the media, and the direction perpendicular to relative motion of the media and writehead will be referred to as the "y-direction," or "across" the media. Any angular error off of either x or y will be referred to as "theta" or "skew."

The writehead can have alignment features capable of interacting with the alignment features of the media. The electrodes of the writehead can be spatially located to the alignment features, such that when the alignment features of the writehead and media are aligned, the electrical contacts of the media are aligned with the electrodes of the writehead.

The electrical contacts can be on the view side, back side, or both sides of the media. The writehead can consist of at least two separate pieces when the electrical contacts are on both sides of the media, wherein the pieces move simultaneously relative to the media. The electrodes of the writehead can be energized to apply a drive signal to the electrical contacts of the media, changing the optical state of selected areas of the display. The media and writehead can be moved relative to each other to allow the writehead to address another section of the media. The writehead can move relative to the media using interaction of the alignment features for location of the writehead on the media, movement of the writehead relative to the media, or both.

A display drive source can be connected to the writehead to provide a drive signal. The display drive source can be a circuit board. According to certain embodiments, the display drive source can include a power source, such as a battery. According to other embodiments, the display drive source can be connected to an external power source, for example, a battery or an electrical circuit. The display drive source can be connected to the writehead physically. The display drive source can be electrically connected to the writehead directly or through some secondary connections, such as wires.

A driving mechanism can be provided to impart relative motion between the media and writehead. The driving mechanism can be incorporated into the writehead, the media or both. When the driving mechanism is part of the writehead, it can be nip rollers, a stepping action motor, or any other means capable of advancing the writehead a set distance relative to the media. The drive mechanism can be outside forces, such as external rollers, manual labor, gravity, or any other means capable of moving the writehead, the display media, or both.

The system can include an optical scanner to verify the optical state of portions of the discrete written areas. The optical scanner can be located on the writehead.

The display and signage system can be understood with reference to certain embodiments including a cholesteric liquid crystal display element, as depicted in the Figures and described below.

FIG. 1 is a top view of one media configuration for a directly driven, pixilated media 1 to be used in conjunction with an indexing writehead. In this embodiment, the media 1 can include a substrate 2, which can be coated with a first conductive layer 4. The display can be viewed from the substrate side if the substrate 2 includes a transparent polymer such as, for example, polyethyleneterephthalate (PET), polyethylenenapthalate (PEN), or polycarbonate. The first conductive layer 4 can be transparent, for example, through the use of indium tin oxide (ITO), polythiophene, carbon nanotubes, or any other clear conductor. The first conductive layer 4 can be patterned or unpatterned, depending on the media configuration. The media 1 can be viewed from the opposite side, which would enable the substrate 2 and conductive layer 4 to be opaque.

Regardless of view direction, the substrate 2 can be coated with an electrically switchable, bistable material 3. The bistable material layer 3 can be formed or applied to the substrate 2, or when a first conductive layer 4 is present, can be on at least a portion of the first conductive layer 4. In this example, the bistable material is a polymer dispersed liquid crystal material.

A second conductive layer 5 can be coated or deposited onto the bistable layer. The conductive layer 5 can be patterned or planar. Patterning of each of the second and first conductive layers can be striped, pixilated, or a combination thereof. If both conductive layers are striped, the direction of the stripes is not parallel. The second conductive layer can be any opaque conductor such as conductive ink, sputter-coated metal, or laminated foil. In other embodiments, the second conductive layer can be a transparent conductor such as indium tin oxide (ITO), polythiophene, or carbon nanotubes. The layer can be patterned in a variety of ways including, but not limited to, screen printing, inkjet deposition, laser etching, chemical etching, or shadow masking. The second conductive layer 5 can be patterned in such a way to work with the pattern of the first conductive layer 4 to form discrete write areas 10. A discrete write area (DWA) 10 is defined as an area of the media, which can be completely addressed by the writehead, without changing or degrading the optical state of the remainder of the media 1, hereafter referred to as "crosstalk." The media can include any number of DWAs 10, for example, 1, 9, 50, 100, 1000, or more, each of which is addressed by the writehead in turn. More than one DWA can be addressed simultaneously by the writehead.

Figure 2:
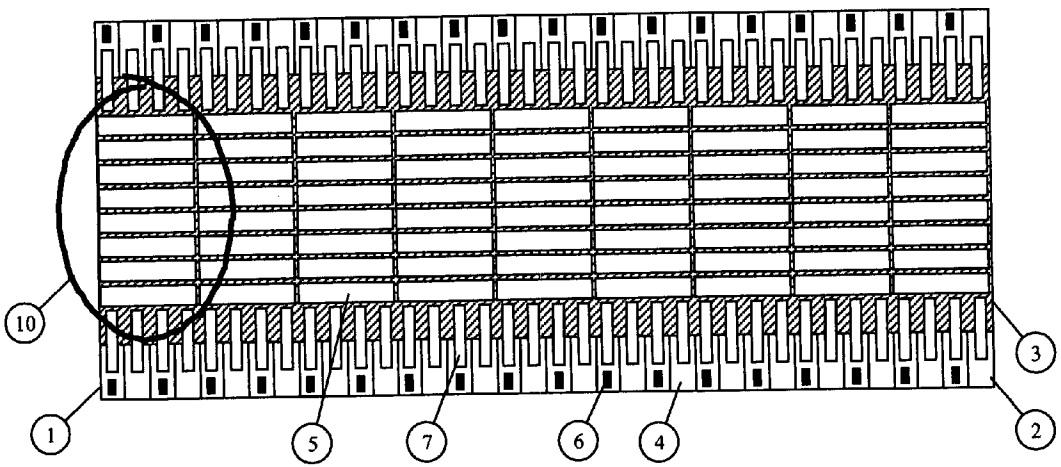
FIG. 2 is a top view of a passive-drive, pixilated media.

The DWAs 10 can be arranged such that they are spatially related to at least one set of alignment features 6,7 on the substrate, as shown in FIG. 1 and FIG. 2. The alignment features 6,7 can be mechanically, electrically, or optically recognizable, or any combination thereof. Examples of a mechanically recognizable feature can include a hole, indent, protrusion, or any other physical feature. Examples of electrically recognizable features can include a switch, jumper wire, or any other electrical feature. Examples of optical features can include fiducials of any shape or color, which can be printed, etched, punched, cut, or any other method of generating an optically recognizable area. For example, at least one alignment feature can be a series of periodic perforations. The media alignment features 6, for example, perforations, can be designed to work in conjunction with corresponding alignment features, for example, protrusions, on the writehead to control the alignment of the writehead to the media 1. Methods of establishing this relationship will be described with regard to FIG. 3 and FIG. 4.

According to one embodiment, an electrically recognizable alignment feature, for example, electrical jump wires 7, can be located at the leading edge, the trailing edge, or both edges of one or more DWA 10. Two exposed, electrically separated leads can be included on the writehead, located such that jump wire 7 can provide brief electrical continuity between them when the leads contact the jump wire 7. The writehead can recognize the contact, and initiate sending the signal to address that DWA 10. The signal can be set to terminate after a specific time, or when the next jump wire 7 is encountered, for example, when a jump wire is used at both the leading and trailing edge of the DWA 10. In addition to providing a method of sensing location in the direction of media 1 motion relative to the writehead motion, the jump wires 7 can be used as connections to the first conductive layer 4 in some media configurations.

FIG. 1. illustrates an embodiment of media 1, which utilizes an unpatterned first conductive layer 4 in conjunction with a second conductive layer 5 that has been patterned into an array of individual electrical contacts 9. Electrical contacts 9 are defined as areas of the media that can be assigned optically independent states, which is typically accomplished by providing one voltage on the second conductive layer 5, and a second voltage on the first conductive layer 4. The area at which the two conductive layers overlap forms a pixel, and depending on the voltages applied, the pixel can either change optical state, or remain in a given present optical state. In the media described by FIG. 1, the pixels must all be directly driven, such that an electrical signal must be applied to each electrical contact 9 independently. This method of driving has several advantages, including a greater flexibility in optical material choices, ability to drive the pixels without crosstalk, and the ability to form the first conductive layer 4 as a non-patterned layer. Depending on the number of pixels in the DWA 10, alternative methods of driving the display can be used that reduce the number of writehead electrodes required.

FIG. 2 illustrates such an alternative system. In this embodiment, each DWA 10 is a passive matrix. Both the first conductive layer 4 and the second conductive layer 5 can be patterned into an array of electrically isolated lines. The first conductive layer 4 lines (hereafter referred to as "columns"), and the second conductive layer 5 lines (hereafter referred to as "rows") are non-parallel, and the areas of intersection form a pixel array. Individual pixels are addressed by applying a first voltage to the row and a second voltage to the column containing the desired pixel, and a third voltage to the remaining rows and columns in the DWA 10. The addressed pixel changes, and the remaining pixels maintain their current optical state.

Figure 3:
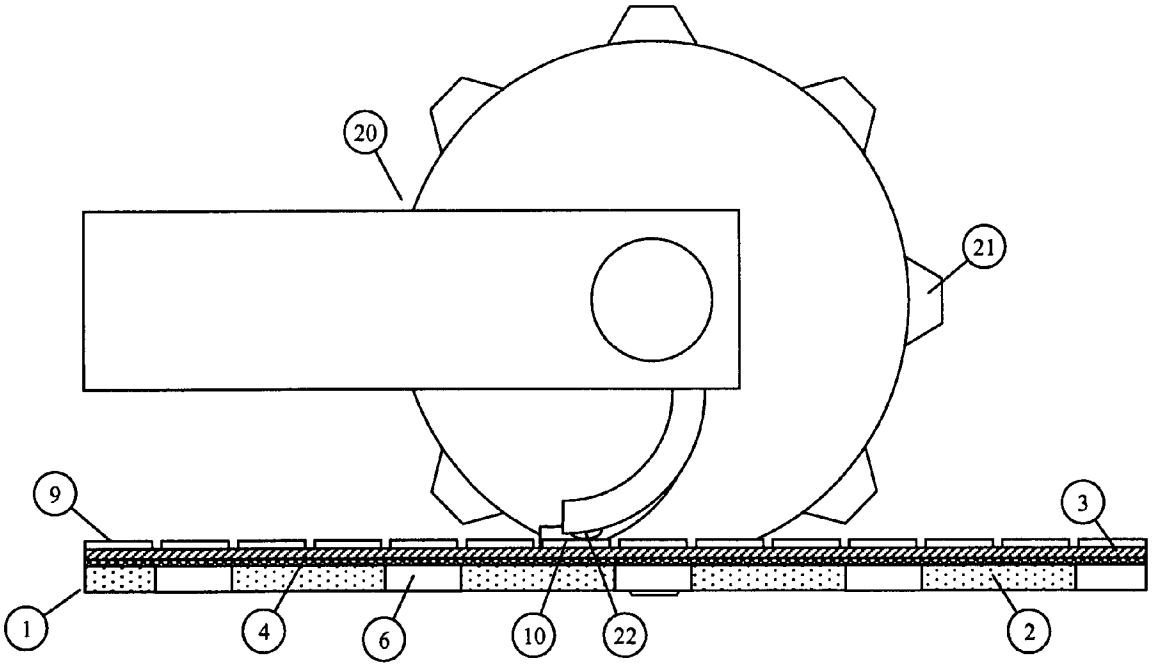
FIG. 3 is a side view of a continuous writehead.
Figure 4:
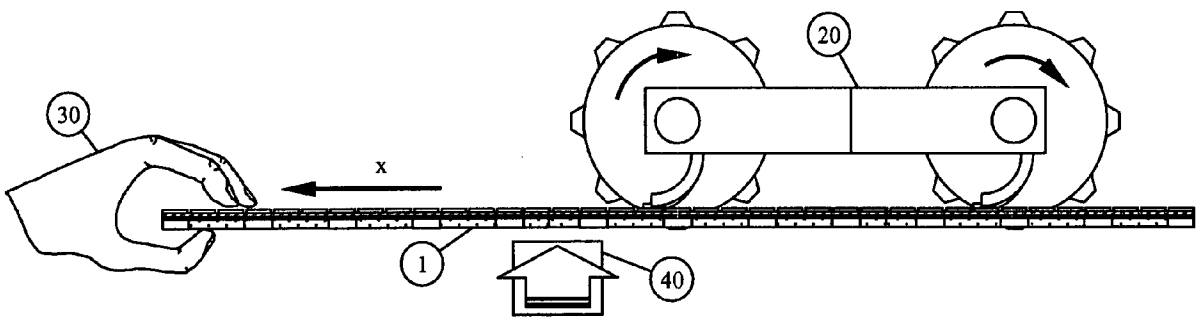
FIG. 4 is a side view of the operation of the writehead assembly shown in FIG. 3.

FIGS. 3 through 6 illustrate examples of writehead configurations for use in conjunction with the media. The writehead shown in FIG. 3 represents a schematic view of a continuous motion system. FIG. 4 is a variation of the system shown in FIG. 3 with two writeheads. In a continuous motion system, the media 1 and the electronic writehead 20 continuously move relative to each other. Relative motion can refer to the writehead moving past stationary media, media moving past the stationary writehead, both the writehead and media moving in different directions, or the writehead and media moving in the same direction, but at different rates of speed. In the continuous motion system, the writehead 20 includes an array of individual write electrodes 22, which are typically equal in number and pitch to the electrical contacts 9 on the media 1 for a DWA 10. The presence of the electrical contacts 9 on the media 1 enables a non-instantaneous drive signal to be used, despite the continuous motion. The maximum time for the write signal is the length of the pixel in the x-direction, divided by the rate of relative motion between the write electrode 22 and media 1.

Alignment between the write electrodes 22 and the pixel conductive layers 5 can be accomplished in many ways. For example, as shown in FIGS. 3 and 4, alignment in y and theta can be accomplished through the use of one or more rotating wheel patterned with alignment protrusions 21 patterned to interact with perforated alignment features 6 in the media 1. The writehead electrodes 22 are precisely located in the y-direction to the alignment protrusions 21, and the electrical contacts 9 are precisely located to the perforated alignment features 6. Therefore, the writehead protrusions 21 can precisely interact with the media perforations 6 to control y and theta alignment of the electrical contacts 9 and writehead electrodes 22. Location of he writehead on the media in the x-direction can be recognized, for example, through the use of jump wires on the media and electrodes on the writehead as described in the electrical alignment method earlier.

Location or alignment of the writehead relative the media can also be accomplished through the use of an optical scanner 40. The optical scanner can be incorporated into the writehead 20. The optical scanner 40 can be programmed to observe optical features on the media 1, and to send a signal to the write electrodes 22 when it is time to write. The scanner 40 can be positioned on the view side of the media 1 downstream from the write electrodes 22 such that it can be used to check the optical state of each column of pixels as they pass. This enables verification that the correct image is written on the pixels, and can be used to initiate corrective action if a problem develops.

The relative motion of the media 1 and the writehead 20 can be imparted using any available means, including, but not limited to, manual labor, motors, gravity, electrostatic force, or any other method. A driving mechanism 30 can be incorporated into the writehead 20, the media, both, or a separate system. More than one driving mechanism 30 can be used, and if multiple driving mechanisms 30 are used, they can be of different types.

Figure 5:
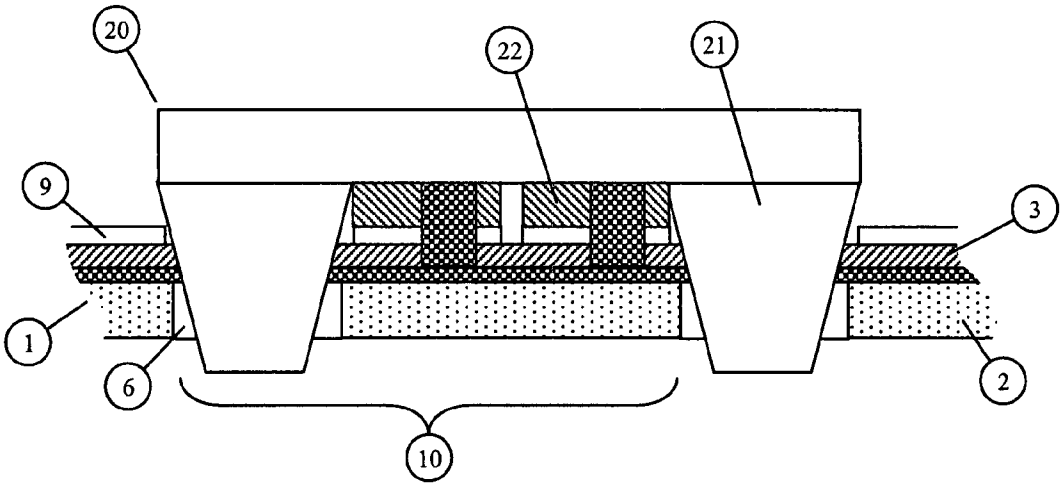
FIG. 5 is a side view of an intermittent writehead.
Figure 6:
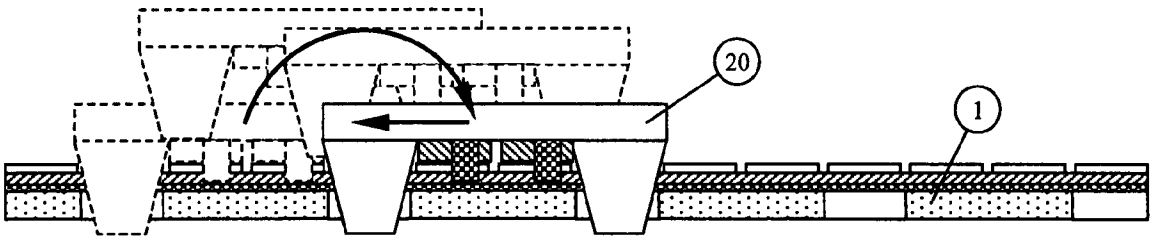
FIG. 6 is a side view of the operation of the writehead assembly shown in FIG. 5.

Continuous systems such as these shown in FIG. 3 and FIG. 4 can be used for directly-driven media. For passive matrix systems, an intermittent system can be used, as shown in FIG. 5 and FIG. 6. In an intermittent system, the media 1 and writehead 20 can move relative to each other at certain intervals. The DWA 10 can be written during the period of no relative motion. This is desirable for a passively-matrixed system, in that the write period for a DWA in a passively-matrixed system is typically longer than that for a direct-drive system.

In the embodiments shown in FIG. 5 and FIG. 6, the alignment protrusions 21 provide x, y, and theta alignment between the write electrodes 22 and the electrical contacts 9. As in the continuous system, the write electrodes 22 are precisely located to the writehead protrusions 21, and the electrical contacts 9 are precisely located to the media perforations 6. The alignment protrusions 21 can disengage from the media 1, index to the next DWA 10, and reengage with the next set of media alignment perforations 6. According to various embodiments, the write voltage is applied to the electrical contacts 9 through the write electrodes 22 while the media 1 and writehead 20 are not in relative motion. The writehead can be used to move the media.

The invention has been described in detail with particular reference to certain preferred embodiments thereof, but it will be understood that variations and modifications can be effected within the spirit and scope of the invention.

PARTS LIST

1 display media
2 media substrate
3 optical layer
4 first conductive layer
5 second conductive layer
6 physical media alignment feature
7 electrical media alignment feature
9 electrical contacts
10 discrete write area
20 electronic writehead
21 writehead alignment features
22 writehead electrodes
30 relative motion force generator
40 optical scanner

The invention claimed is:

1. A system for writing a bistable media, the system comprising:

the bistable media, including:

a substrate;

two or more discrete write areas on the substrate, each write area comprising first and second conductors and a bistable material layer interposed therebetween, the second conductor of each write area having been patterned into a plurality of contacts so as to form a plurality of individual electrical areas, the bistable material layer being selectively operable in a transmissive mode or a reflective mode; and at least one media alignment feature on the substrate, the at least one media alignment feature comprising at least one of one or more perforations, indentations, protrusions, switches or jumper wires, the at least one media alignment feature being arranged in a spatial relation to the two or more discrete write areas; and one or more writeheads movable relative to the bistable media, each writehead being configured to interact with the two or more discrete write areas and comprising:

one or more electrodes that, for each write area, are configured to contact the contacts of the second conductor and provide power to the first conductor and selective ones of the contacts of the second conductor so as to form an electric field therebetween, and a writehead alignment feature configured to interact with the at least one media alignment feature to align the electrodes of the writehead with the bistable media, the writehead alignment feature comprising at least one of one or more perforations, indentations, protrusions or conductive leads.

2. The system of claim 1, further comprising a mechanism for moving the one or more writeheads and the bistable media in relation to one another.

3. The system of claim 2, wherein the mechanism comprises at least one of traction feed, manual feed, a push bar, or a combination thereof.

4. The system of claim 2, wherein the mechanism provides intermittent relative motion of the media and the one or more writeheads.

5. The system of claim 2, wherein each writehead further comprises the mechanism to move the writehead and the bistable media in relation to each other.

6. The system of claim 5, wherein the mechanism comprises the writehead alignment feature.

7. The system of claim 1, wherein the electrodes of each writehead comprise a flex conductor.

8. The system of claim 1, wherein the first conductor of each write area is also patterned, the first and second conductors of each write area being patterned into an array of electrically isolated lines.

9. The system of claim 1, further comprising an optical scanner.

10. A system for writing a bistable media, the system comprises:

the bistable media, the bistable media including:

a substrate;

two or more discrete write areas on the substrate, each write area comprising first conductor and second conductors and a bistable material layer interposed therebetween, the second conductor of each write area having been patterned into a plurality of contacts so as to form a plurality of individual electrical areas, the bistable material layer being selectively operable in a transmissive mode or a reflective mode;

at least one media alignment feature on the substrate, the at least one media alignment feature comprising at least one or more perforations, indentations, protrusions, switches or jumper wires, the at least one media alignment feature being arranged in a spatial relation to the two or more discrete write areas; and two or more writeheads movable relative to the bistable media, each writehead being configured to interact with the two or more discrete write areas and comprising:

one or more electrodes that, for each write area, are configured to contact the contacts of the second conductor and provide power to the first conductor and selective ones of the contacts of the second conductor so as to form an electric field therebetween, and a writehead alignment feature configured to interact with the at least one media alignment feature to align the electrodes of the writehead with the bistable media, the writehead alignment feature comprising at least one of one or more perforations, indentations, protrusions or conductive leads.

11. A method of writing a bistable media one portion at a time, the bistable media comprising a substrate; two or more discrete write areas on the substrate, each write area comprising first and second conductors and a bistable material layer interposed therebetween, the second conductor of each write area having been patterned into a plurality of contacts so as to form a plurality of individual electrical areas, the bistable material layer being selectively operable in a transmissive mode or a reflective mode; and at least one media alignment feature on the substrate, the at least one media alignment feature comprising at least one of one or more perforations, indentations, protrusions, switches or jumper wires, the at least one media alignment feature being arranged in a spatial relation to the two or more discrete write areas, the method comprising:

contacting the bistable media with a writehead movable relative to the bistable media, the writehead configured to interact with the two or more discrete write areas and comprising: one or more electrodes that, for each write area, are configured to contact the contacts of the second conductor with the electrodes, the electrodes being configured to provide power to the first conductor and selective ones of the contacts of the second conductor so as to form an electric field therebetween, and a writehead alignment feature comprising at least one of one or more perforations, indentations, protrusions or conductive leads;

interacting the at least one media alignment feature with the writehead alignment feature to align the one or more electrodes of the writehead with the bistable media; and moving the bistable media and the writehead relative to each other.

12. The method of claim 11, further comprising writing to the two or more discrete write areas.

13. The method of claim 11, further comprising moving the media and the writehead relative to each other and simultaneously writing to the two or more discrete write areas.

14. The method of claim 11, further comprising repeating the steps of interacting the at least one media alignment feature with the writehead alignment feature and moving the media and the writehead relative to each other.

15. The method of claim 11, further comprising optically scanning the bistable media.

16. A method of writing a bistable media one portion at a time, the bistable media comprising a substrate; two or more discrete write areas on the substrate, each write area comprising first and second conductors and a bistable material layer interposed therebetween, the second conductor of each write area having been patterned into a plurality of contacts so as to form a plurality of individual electrical areas, the bistable material layer being selectively operable in a transmissive mode or a reflective mode; and at least one media alignment feature on the substrate, the at least one media alignment feature comprising at least one of one or more perforations, indentations, protrusions, switches or jumper wires, the at least one media alignment feature being arranged in a spatial relation to the two or more discrete write areas, the method comprising:

interacting the media alignment feature with a writehead alignment feature of a writehead movable relative to the bistable media and including one or more electrodes that, for each write area, are configured to provide power to the first conductor and selective ones of the contacts of the second conductor so as to form an electric field therebetween, the media alignment feature configured to interact with the writehead alignment feature to align the writehead with the bistable media, the writehead alignment feature comprising at least one of one or more perforations, indentations, protrusions or conductive leads; and moving the writehead and the bistable media relative to one another.

17. The method of claim 11 further comprising writing to a display, wherein the display comprising the bistable media.

18. The system of claim 1, wherein the at least one media alignment feature or writehead alignment feature comprises one or more protrusions, and the other of the at least one media alignment feature or writehead alignment feature comprises at least one of one or more perforations or indentations.

19. The system of claim 10, wherein the at least one media alignment feature or writehead alignment feature comprises one or more protrusions, and the other of the at least one media alignment feature or writehead alignment feature comprises at least one of one or more perforations or indentations.

20. The method of claim 11, wherein the at least one media alignment feature or writehead alignment feature comprises one or more protrusions, and the other of the at least one media alignment feature or writehead alignment feature comprises at least one of one or more perforations or indentations.

21. The method of claim 16, wherein the at least one media alignment feature or writehead alignment feature comprises one or more protrusions, and the other of the at least one media alignment feature or writehead alignment feature comprises at least one of one or more perforations or indentations.

* * * * *